United States Patent [19]

Sherwin

[11] 4,130,124

[45] Dec. 19, 1978

[54] PAINT ROLLER CLEANER

[76] Inventor: Raymond H. Sherwin, 1521 Fourth Ave. NW., Jamestown, N. Dak. 58401

[21] Appl. No.: 841,664

[22] Filed: Oct. 13, 1977

[51] Int. Cl.[2] ..... B08B 3/02

[52] U.S. Cl. ..... 134/138; 134/149

[58] Field of Search ..... 134/138, 139, 149

[56] References Cited

U.S. PATENT DOCUMENTS

| | | | |
|---|---|---|---|
| 2,938,368 | 5/1960 | Bixel | 134/138 X |
| 3,688,785 | 9/1972 | Stevens et al. | 134/138 |
| 3,755,840 | 9/1973 | Barger | 134/138 X |
| 4,061,153 | 12/1977 | Doherty | 134/138 |

FOREIGN PATENT DOCUMENTS

| | | | |
|---|---|---|---|
| 2,407,578 | 2/1974 | Fed. Rep. of Germany | 134/149 |
| 2,360,884 | 6/1975 | Fed. Rep. of Germany | 134/138 |

*Primary Examiner*—Robert L. Bleutge

*Attorney, Agent, or Firm*—Merchant, Gould, Smith, Edell, Welter & Schmidt

[57] ABSTRACT

A pair of housing members, having latches for releasably holding them together, define an elongated chamber for supporting therein a paint roller. An inlet manifold extends along a wall of the chamber and has a portion extending through a housing wall for connection to a source of cleaning liquid under pressure. Within the chamber, the manifold has outlet openings to direct cleaning liquid toward a paint roller supported in the chamber. The manifold is movable to direct liquid at different angles toward the paint roller. The housing members provide a discharge opening through which the cleaning liquid escapes from the chamber. A valve arrangmeent is provided for admission of air under pressure to the manifold, for drying of a cleaned paint roller within the chamber.

2 Claims, 5 Drawing Figures

PAINT ROLLER CLEANER

BACKGROUND OF THE INVENTION

This invention relates to the removal of paint from applicators in the nature of paint rollers. Heretofore, paint rollers have been cleaned by immersing them in solvents such as turpentine or mineral spirits. When used with rubber or latex based paints, the rollers have been in cleaned in containers of water or by holding them in a stream of water from a faucet. Both procedures have been less than satisfactory, being both untidy and time consuming, requiring the hands of the operator to become soaked in the mixture of paint and cleaning liquid. The primary object of this invention is provision of a device by means of which paint rollers can be efficiently and thoroughly cleaned.

SUMMARY OF THE INVENTION

The paint roller cleaner of the present invention involves a housing having side walls and opposite end walls defining an elongated chamber for reception of a paint roller and a portion of a paint roller handle at one end of the paint roller. An inlet manifold extends along one side of the chamber and defines a plurality of longitudinally spaced openings, said manifold having a portion projecting through one of said walls for connection to a source of pressurized cleaning liquid. Said side wall structure defines discharge aperture means generally opposite the manifold. Means is provided for moving said manifold in directions to vary the direction of discharge of cleaning fluid against the surface of a paint roller rotatably disposed in said chamber.

DETAILED DESCRIPTION OF THE PREFERRED EMBODIMENT

Figure 4:
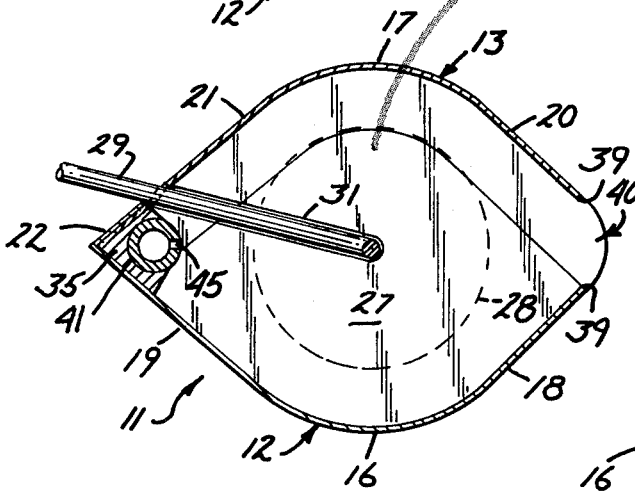
FIG. 4 is an enlarged transverse section taken on the line 4—4 of FIG. 1.
Figure 5:
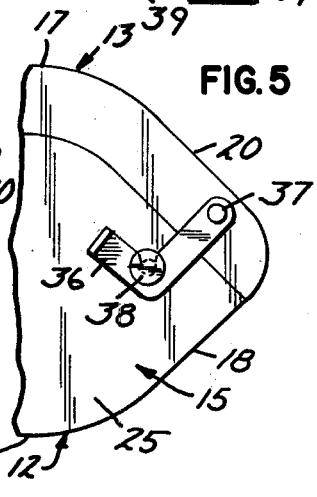
FIG. 5 is a fragmentary view in end elevation opposite that shown in FIG. 2.

In the drawings, an elongated housing, indicated generally at 11, is shown as comprising a pair of opposed side walls 12 and 13 and opposite end walls 14 and 15. The side walls 12 and 13 have cross sectionally arcuate central portions 16 and 17 respectively. The side wall 12 has flat side portions 18 and 19 that are tangent to the arcuate wall portion 16, the side wall 13 having flat side wall portions 20 and 21 that are tangent to the arcuate wall portion 17. Further, the wall portion 19 is folded in spaced parallel relation to its outer edge to provide an angularly displaced flange 22 that is adapted to overlie an adjacent outer edge of the flat wall portion 21, as shown in FIG. 4. The walls 12 and 13 are preferably made from sheet stock, such as sheet metal, synthetic plastics or other suitable material.

The end wall 14 comprises a pair of cooperating end wall sections 23 and 24, the former of which is rigidly secured to one end of the side wall member 12 and the latter of which is rigidly secured to the same end of the side wall member 13. The end wall 15 likewise comprises a pair of cooperating end wall sections 25 and 26 rigidly secured to the other ends of the side wall members 12 and 13 respectively. Preferably, the end wall sections 23–26 are made from suitable material having substantially greater thickness than that of the side walls 12 and 13.

Figure 1:
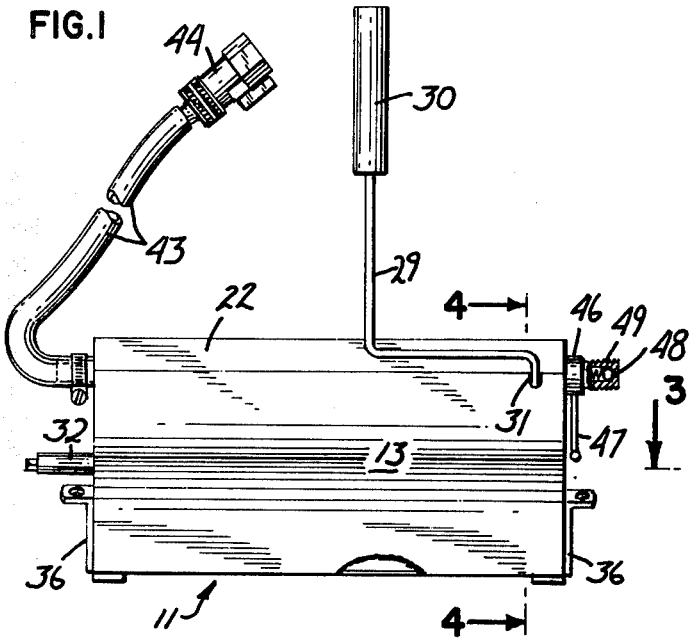
FIG. 1 is a view in top plan of a paint roller cleaner produced in accordance with this invention.
Figure 2:
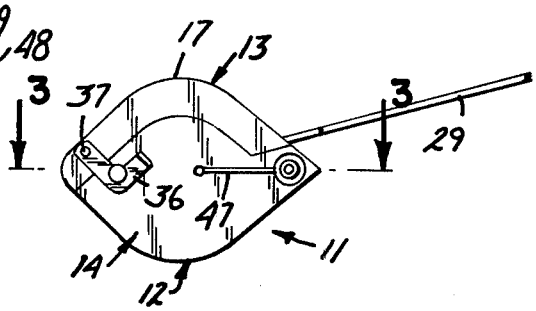
FIG. 2 is a view in end elevation.
Figure 3:
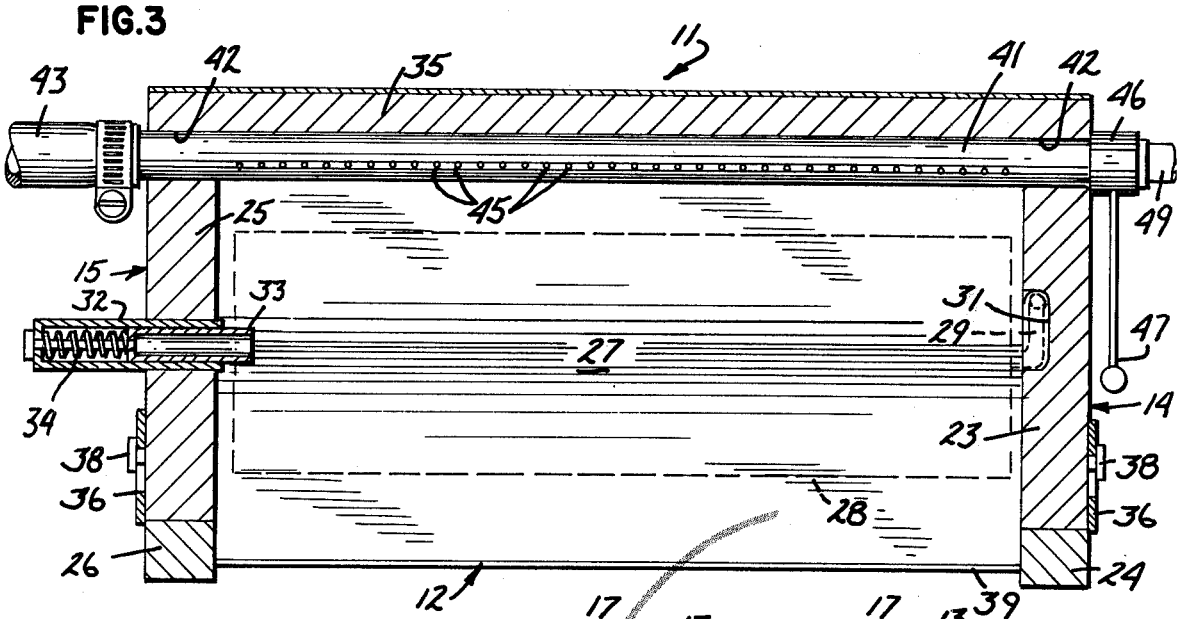
FIG. 3 is an enlarged horizontal section taken on the line 3—3 of FIG. 2.

The side wall members 12 and 13 with their respective end wall sections 23–26 cooperate to define an elongated chamber 27 for reception of a conventional paint roller shown by dotted lines in FIGS. 3 and 4, and indicated at 28. The roller 28 is of conventional and well known structure, having an elongated handle 29 extending from one end thereof and provided with a hand grip portion 30 at its outer end. As shown, the end wall sections 23 and 24 cooperate to define a groove-like recess 31 for reception of a portion of the roller handle 29. The opposite end wall section 25 is provided with a socket 32 in which is axially slidably mounted a bolt equipped tubular shaft 33 that, by means of a coil compression spring 34, is yieldingly urged axially toward engagement with the adjacent end of the paint roller 28 to support the roller 28 for rotation within the chamber 27.

The end wall sections 23 and 25 are connected by a bearing portion 35 disposed adjacent the flange 22 of the flat wall 19. With reference to FIG. 4, it will be seen that the edge portion of the flat wall portion 21 is insertable between the bearing portion 35 and flange 22 when the end wall portions 24 and 26 are disposed in abutting relationship with their respective end wall sections 23 and 25, to provide the chamber 27. Means for releasably holding the wall sections 24 and 26 in engagement with their respective end wall sections 23 and 25 comprises a pair of latch members 36, one each pivotally secured to a different end wall section 24 and 26, as indicated at 37, and each pivotally movable into and out of latching engagement with a respective latch pin 38 on the end wall sections 23 and 25 respectively. Thus, the latches 36 cooperate with the flange 22 in holding the housing members together in chamber forming relationship. With reference particularly to FIG. 3, it will be seen that the flat wall portions 18 and 20 have side edges 39 that cooperate to define a discharge opening 40 for discharging cleaning liquid from the chamber 27.

Means for delivering cleaning fluid to the chamber 27, and for directing streams of the cleaning fluid toward the paint roller 28 comprises a tubular manifold 41 that extends longitudinally of the chamber 27 and which is supported by the bearing portion 35, the manifold 41 having opposite end portions extending through openings 42 in the opposite end wall sections 23 and 25, as shown in FIG. 3. A conduit, in the nature of a flexible hose 43, is clamped to one end of the tubular manifold 42 and is provided with a conventional fitting 44 by means of which the hose 43 may be connected to a source of cleaning fluid under pressure, not shown. Within the chamber 27, the tubular manifold 41 is provided with a row of longitudinally spaced radial outlet openings 45 through which cleaning liquid is directed toward the paint roller 27. Means for rotating the manifold 41, to vary the direction of streams of liquid from the manifold 41 toward the paint roller 28, comprises a collar 46 fixed on the manifold 41 outwardly of the housing end wall 14, and a controll handle 47 extending radially outwardly from the collar 46. The outer end of the manifold 41 outwardly of the collar 46 contains a spring pressed ball check valve 48, and is screw threaded, as indicated at 49 for reception of a suitable fitting on an air hose, not shown. When cleaning liquid, such as water, is delivered to the manifold 41 and through the openings 45 against the paint roller 28, the ball check valve 48 prevents escape of cleaning liquid from its respective end of the manifold 41.

By manipulating the control handle 47, the tubular manifold 41 is pivotally moved to direct jets of cleaning liquid radially toward the paint roller 28, or in various directions angularly spaced from a true radial direction. By angularly spacing the direction of liquid from a true radial direction, the force of cleaning liquid against the paint roller 28 will cause the same to rotate, the speed of rotation thereof being controlled by varying the direction of cleaning liquid impinging thereagainst. As the cleaning liquid either drops from or is thrown from the paint roller 28, it flows outwardly through the discharge opening 40, to be reclaimed or otherwise disposed of.

After the paint roller has been properly washed by the streams of cleaning liquid from the manifold 41, the supply of cleaning liquid is shut off, and an air hose is applied to the screw threaded end 49 of the manifold 41, so that jets of air under pressure are directed against the paint roller 28. By manipulating the manifold 41, so that the jets of air are directed generally tangentially of the roller 28, the roller 28 is caused to spin at a rapid rate and discharge cleaning fluid by centrifugal action. The combination of centrifugal discharge and impingement of air against the roller 28 causes the roller 28 to become sufficiently dry in a short time so that the roller may be reused without delay, such as when it is desired to use the roller with paint of a different color than formerly.

While a preferred embodiment of the paint roller cleaner of this invention has been shown and described, it will be understood that the same is capable of modification without departure from the spirit and scope of the invention, as defined in the claims.

What is claimed is:

1. A paint roller cleaner comprising:

(a) a housing having side walls and opposite end walls defining an elongated chamber for reception of a paint roller and a portion of a paint roller handle at one end of the paint roller;

(b) a tubular inlet manifold extending along one side of said chamber and mounted in said housing for pivotal movements on its own axis, said tubular manifold having opposite end portions extending through said end walls for connection of one of said end portions to a source of pressurized cleaning liquid;

(c) said side walls defining discharge aperture means generally opposite said manifold;

(d) and a handle fixed to the other one of the end portions of said manifold for imparting pivotal movements to said manifold to vary the direction of discharge of cleaning liquid against the surface of a paint roller rotatably disposed in said chamber.

2. The paint roller cleaner defined in claim 1 in further combination with a check valve normally closing said other one of the end portions of said manifold, said check valve being disposed to admit air under pressure to said manifold.

* * * * *